United States Patent [19]

Wolff et al.

[11] Patent Number: 4,939,079

[45] Date of Patent: Jul. 3, 1990

[54] PHOTOGRAPHIC RECORDING MATERIAL

[75] Inventors: Erich Wolff, Solingen; Hans Langen, Bonn; Wolfgang Himmelmann, Leverkusen; Günter Helling, Odenthal, all of Fed. Rep. of Germany

[73] Assignee: Agfa/Gevaert Aktiengessellschaft, Leverkusen, Fed. Rep. of Germany

[21] Appl. No.: 313,302

[22] Filed: Feb. 15, 1989

Related U.S. Application Data

[63] Continuation of Ser. No. 22,983, Mar. 6, 1987, abandoned.

[30] Foreign Application Priority Data

Mar. 18, 1986 [DE] Fed. Rep. of Germany ..... 3608998

[51] Int. Cl.[5] ..... G03C 1/30; G03C 7/38

[52] U.S. Cl. ..... 430/558; 430/621; 430/623; 430/628; 430/642

[58] Field of Search ..... 430/621, 622, 623, 624, 430/625, 626, 628, 642, 558

[56] References Cited

U.S. PATENT DOCUMENTS

| | | | |
|---|---|---|---|
| 3,132,945 | 5/1964 | Ryan | 430/628 |
| 4,057,538 | 11/1977 | Habu et al. | 430/623 |
| 4,421,847 | 12/1983 | Junbg et al. | 439/621 |
| 4,618,573 | 10/1986 | Okamura et al. | 430/621 |
| 4,670,377 | 6/1987 | Miyoshi et al. | 430/621 |

*Primary Examiner*—Paul R. Michl
*Assistant Examiner*—Mark R. Buscher
*Attorney, Agent, or Firm*—Connolly & Hutz

[57] ABSTRACT

Photographic recording materials of which the binder layers consist of protein-like binders which have been hardened in the usual way show reduced susceptibility to the effect of formaldehyde when—in addition to the usual hardeners—low molecular weight monofunctional compounds which are capable of reacting with free primary amino groups of the binder under casting and/or storage conditions without causing additional hardening are allowed to act on the binder.

6 Claims, No Drawings

PHOTOGRAPHIC RECORDING MATERIAL

This application is a continuation of application Ser. No. 07/022,983, filed Mar. 6, 1987.

This invention relates to a photographic recording material comprising at least one hardened silver halide emulsion layer which contains a protein-like binder, particularly gelatin, and which is protected against the damaging effect of formaldehyde by special additives.

Photographic recording materials normally consist of a layer support and—arranged thereon—photosensitive, gelatin—containing silver halide emulsion layers and optionally non-photosensitive auxiliary layers likewise containing gelatin. The photosensitive silver halide gelatin emulsion layers of color photographic recording materials contain the dye components required to form the image dyes in the three primary colors. The multilayer recording materials mentioned here, which are used in black-and-white and color photography, and their production are generally known and are described, for example, in Ullmanns Enzyklopädie der technischen Chemie, 4th Edition, Vol. 18, in the Chapter entitled "Photography".

Since the gelatin layers, of which the photographic recording material is made up, should not undergo excessive swelling and should be mechanically strong enough not to be damaged during processing, they are treated with crosslinking agents also known as hardeners. The hardeners used include both inorganic and organic photographically inert compounds which is capable of crosslinking gelatin through the carboxyl groups and/or the amino groups. Examples of known hardeners are aldehydes, for example formaldehyde, glyoxal, glutaraldehyde, aldehydic acids, for example mucochloric acid, diketones, for example diacetyl, dihalides, for example 1,3-dichloropropanol, bis-vinyl sulfone compounds, diisocyanate bisulfate compounds, bis-epoxides, bis-aziridines, peptide reagents, such as carbodiimides, N-carbamoyl pyridinium and isoxazolium salts or substituted 2,3-dichlorotriazines, for example N,N',N''-tris-acryloyl perhydro-s-triazine.

It Is known that certain difficulties are involved in the use of the above-mentioned aldehydes, such as glyoxal, glutaraldehyde, succinaldehyde and, in particular, formaldehyde, as hardeners. These aldehydes are not only capable of crosslinking the gelatin layers to an almost uncontrollable extent, they are also capable for example of impairing the functionality of the dye components optionally present in the layers and can give rise to fogging. For this reason, other hardeners are generally preferred to aldehydes in practice. However, the adverse effect described can also be expected to occur when the aldehydes are not actually incorporated in the photographic recording materials, but instead penetrate into the photographic layers, for example during—not always avoidable—storage of the photographic recording material in an aldehyde-containing atmosphere. This situation can arise, for example, when photographic recording materials are stored in pieces of furniture made from composite woods (for example plywood) or chipboards which have been glued with a formaldehyde-releasing adhesive. for example a melamine-formaldehyde resin or a phenol-formaldehyde resin. If a photographic recording material is stored in pieces of furniture such as these, the formaldehyde emanating from the glue can cause more or less serious damage to the photographic layers which always impairs the quality of the photographic images produced with the recording material in question. In the case of color photographic recording materials, the deterioration in quality caused by formaldehyde is particularly noticeable because not only is an inadequate maximum color density obtained in that case, the $\gamma$-balance of the three emulsion layers produced in the dye image is significantly disturbed, generally resulting in an unacceptable color tinge.

Various proposals have already been put forward with a view to obviating the described disadvantages caused by oldehydes, particularly formaldehyde. One possibility is to incorporate so-called oldehyde scavengers in the layers of the photographic recording material.

Thus, it is known for example from DE-A-1 772 816 that N,N'-ethylene urea, 2,3-dihydroxynaphthalene or dimedone, for example, can be added to photographic layers to fix formaldehyde. DE-A-23 32 426 describes a photographic recording material which, in addition to a vinyl sulfonyl hardener, contains an acyclic urea as aldehyde scavenger in one of its colloid layers. US-A-3 652 278 describes a process for reducing fogging in photographic recording materials which are to be stored in a formaldehydecontaining atmosphere. In this process, a compound from the group comprising N,N'-ethylene urea, 2,3-dihydroxynaphthalene and 1,1-dimethyl-3,5-diketocyclohexane is incorporated in the silver halide emulsion.

In addition, it is known from US-A-2 309 492 that photographic recording materials containing an aldehyde hardener can be processed in the presence of an organic compound which is capable of reacting with the aldehyde. Compounds of this type include hydroxylamines, hydrazines, hydrazo compounds, semicarbazides, naphthalenediamines and dimethyl dihydroresorcinol. US-A-3 168 400 also relates to a process for stabilizing photographic images, in which the binder of the photographic recording material is hardened with an aldehyde after exposure, but before development, and the unused aldehyde subsequently removed by treatment with an aqueous solution of an amine compound. Suitable amines are, for example, hydroxylamine, semicarbazide, hydrazine, biuret, aminoguanidine. According to DE-A-22 27 144, aldehyde-containing photographic materials are treated in baths containing hydroxylamines and/or a water-salt of hydroxylamine and an aromatic polyhydroxyl compound containing two hydroxyl groups in the ortho position, for example an o-dihydroxy compound from the benzene series.

According to another proposal, the damaging effect of formaldehyde on the photographic layers is reduced by oxidation of the formaldehyde (DE-A-32 27 962).

The object of the present invention is to provide a photographic recording material having improved stability to the effect of formaldehyde.

The present invention relates to a photographic recording material comprising at least one photosensitive silver halide emulsion layer and at least one layer containing a hardened protein-like binder which contains free primary amino groups in the unhardened state, characterized in that the hardened protein-like binder contains amino groups corresponding to the formula —NH—R, in which R is the residue of a low molecular weight monofunctional compound which has been reacted with the free primary amino groups of the protein-like binder under casting and/or storage conditions.

Accordingly, the photographic recording material according to the invention contains one or more binder layers containing a protein-like binder, preferably gelatin, which has been hardened with a standard hardener, the hardener being selected and gauged in such a way as to give a desired, maximal degree of final hardening at which the layers are sufficiently resistant to damage during processing while, on the other hand, through-developability is still guaranteed. The hardeners used generally contain two or more reactive groups which are capable of reacting with free amino groups of the protein-like binder or, in the case of so-called carboxyl-group-activating hardeners, at least one reactive group which is capable of reacting with free carboxyl groups of the protein-like binder with activation of the latter, a hardened binder matrix being formed by intermolecular linkage (crosslinking) of various molecular chains of the protein-like binder. It has been found that a binder matrix such as this, which has been conventionally hardened to an optimal degree of hardening, undergoes a change when exposed to the action of formaldehyde. The binder matrix would appear to be further hardened in this way to the detriment of through-developability which, in the case of black-and-white materials for example, is reflected in lighter blackening and, in the color materials, in a lower developable color density. This effect occurs to a limited extent, if at all, when the protein-like binder according to the present invention is allowed to react not only with a standard hardener in the usual way, but at the same time or subsequently with a low molecular weight monofunctional compound containing a reactive group which is capable of reacting with primary amino groups of the protein-like binder under conditions under which hardening is normally carried out, i.e. under casting and/or storage conditions.

By virtue of their ability to react predominantly with the amino groups of the protein-like binder, the compounds used in accordance with the invention are termed amino group blocking agents or "amino group blockers" (AB). Compounds of this type may be represented by one of the following general formulae I and II

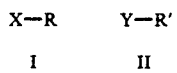

X—R Y—R'

I II in which

X is an activated atom or an activated group which is attached to a C-atom of the substituent R and can be displaced therefrom by an N-atom of a primary amino group;

R is an organic radical containing at least one group by which the atom or the group X is activated;

Y is an activated group onto which a primary amino group may be added in a 1,2- or 1,4-addition reaction; for example an activated vinyl group, an activated C-C-triple bond, an isocyanate group, a quinoid group, a ketene group;

R' represents an organic radical by which the group Y may optionally be activated.

The activated atom or the activated group X is preferably attached to a C-atom of an organic radical which may be an aliphatic or araliphatic or a carbocyclic or heterocyclic aromatic radical. Examples of activated atoms X are, in particular, halogen atoms, such as F, Cl, Br, I.

Examples of activated groups X are, in particular, $—OSO_2—M$,

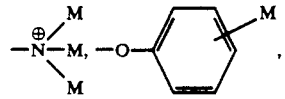

$—N_3$, $—OCO—CH_3$,

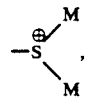

$—SO_2—M$, in which M represents alkyl, aralkyl, aryl or —O— metal.

An activated group may also be, for example, an atom or a group which is attached intramolecularly through another bond to another atom, preferably another C-atom of the radical R, so that a cyclic structure is obtained. In this case, the displacement of the activated group from the first C-atom takes place with opening of the ring. Examples of these formula I compounds having cyclic structures are compounds containing an epoxy or ethylene imine group. In ths case, the activating effect is presumably attributable to the ring tension of the 3-membered rings present. However, the activating effect on the activated atom or the activated group X may also be brough about by the influence of adjacent polar groups.

An activated vinyl group represented by Y is, in particular, a vinyl group attached to a polar group such as a sulfonyl, carbonyl, nitrile or phosphonate group. An activated vinyl group such as this is capable of adding primary amino groups. In general, an activated vinyl group of the type in question is attached to any organic radical trhoguh the activating polar group.

The amino group blockers used in accordance with the invention are low molecular weight compounds having a molecular weight below 400 and preferably below 200.

An important feature of the amino group blockers according to the invention is their monofunctionality. In the context of the invention, thus means that the compounds in question are capable, under the conditions to which photographic recording materials are normally exposed during production and, optionally, storage, of reacting with primary amino groups of the protein-like binder without, at the same time, significantly contributing towards hardening. Accordingly, the amino group blockers according to the invention preferably contain only one functional group of the type corresponding to formulae I and II. According tot he invention, compounds containing more than one such functional group are also regarded as "monofunctional" if they are reacted under conditions where essentially only one of the functional groups present is capable of reacting with an amino group of the binder, while the other no longer has a partner with which to react. Conditions such as these prevail for example when the amino group blockers according to the invention are used together with much faster reacting hardeners or when they only develop their effect after hardening is largely complete and the binder matrix has reached the desired final hardness.

The following are examples of amino group blockers (AB) according to the invention:

$CH_2{=}CH{-}SO_2{-}CH_2{-}CH_2{-}COOH$ AB-1

AB-2

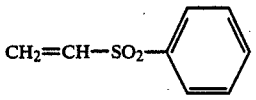

$CH_2{=}CH{-}SO_2{-}C_2H_5$ AB-3

AB-4

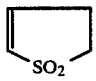

AB-5

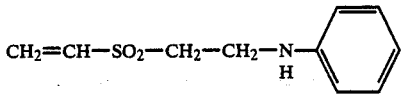

$CH_2{=}CH{-}CONH_2$ AB-6

AB-7

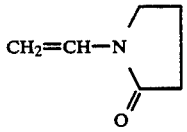

AB-8

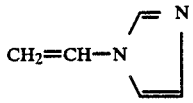

AB-9

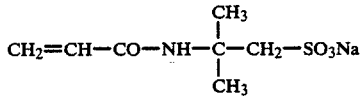

AB-10

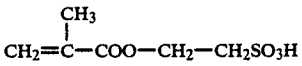

$CH_2{=}CH{-}CO{-}CH_3$ AB-11

$CH_2{=}CH{-}COO{-}CH_2{-}CH_2{-}OH$ AB-12

AB-13

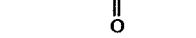

AB-14

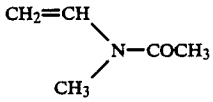

$CH_2{=}CH{-}SO_2{-}CH_2{-}COOH$ AB-15

AB-16

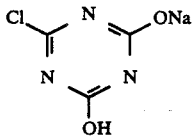

AB-17

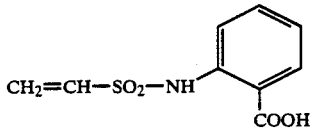

-continued

AB-18

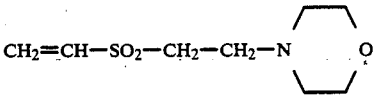

AB-19

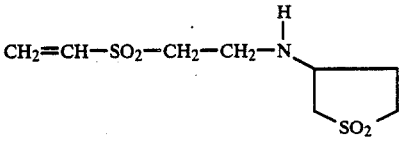

AB-20

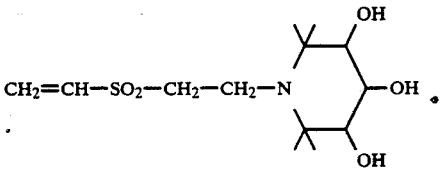

$CH_2{=}CH{-}SO_2{-}CH_2{-}CH_2{-}NH{-}CO{-}NH_2$ AB-21

$CH_2{=}CH{-}SO_2{-}CH_2{-}SO_2{-}CH{=}CH_2$ AB-22

AB-23

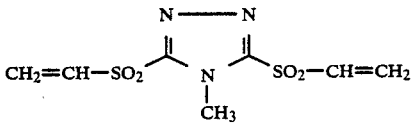

AB-24

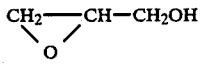

$ClCH_2{-}CO{-}N(CH_3)_2$ AB-25

$ClCH_2{-}CH_2{-}CO{-}N(C_2H_5)_2$ AB-26

$CH_3{-}SO_2{-}OCH_2{-}CH_2{-}O{-}C_2H_5$ AB-27

$Cl{-}CH_2{-}CH_2{-}SO_2{-}CH_2{-}COOH$ AB-28

AB-29

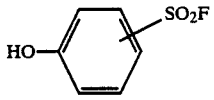

AB-30

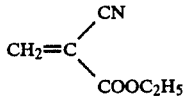

AB-31

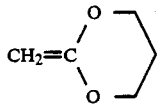

AB-32

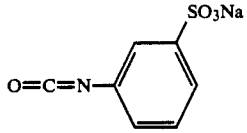

The amino group blockers according to the invention are used either individually or in the form of mixtures of two or more, in either case in combination with known hardeners. Special examples of hardeners which may be used in combination with the amino group blockers according to the invention are aldehyde compounds, such as formaldehyde, glutaraldehyde, ketone compounds, such as diacetyl, cyclopentanedione, compounds containing reactive halogen atoms, such as bis- (2-chloroethylurea)-2-hydroxy-4,6-dichloro-1,3,5-triazine and similar compounds for example of the type described in US-A-3 288 775, US-A-2 732 303, GB-A-974 723 and GB-A-1 167 207, compounds containing reactive olefins, such as divinyl sulfone, 5-acetyl-1,3-diacryloylhexahydro-1,3,5triazine and similar compounds of the type described in US-A-3 635 718, US-A-3 232 763, GB-A-994 869, N-methylol compounds, such as N-hydroxymethyl phthalimide and similar compounds of the type described in US-A-2 732 316 and US-A-2 586 168, isocyanates of the type described in US-A-3 103 437, aziridine compounds of the type described in US-A-3 017 280 and US-A-2 983 611 etc., acid derivatives of the type described in US-A-2 725 294 and US-A-2 725 295, carbodiimide compounds of the type described in US-A-3 100 704, epoxy compounds of the type described in US-A-3 091 537, isoxazole compounds of the type described in US-A-3 321 313 and US-A-3 543 292, halogen carboxaldehydes, such as mucochloric acid, dioxane derivatives, such as dihydroxydioxane, dichlorodioxane, dihydroquinoline compounds, compounds containing a phosphorus-halogen bond, N-sulfonyloxyimide compounds, N-acyloxyimide compounds, N-carbonyloxyimide compounds, 2-sulfonyloxy pyridinium salts, N-carbamoyl pyridinium salts. In addition, inorganic hardeners, such as chrome alum, zirconium sulfate, may also be used in combination. Instead of using the hardeners described above, it is also possible to use hardeners in the form of the corresponding precursors, for example alkali metal bisulfitealdehyde adducts, methylol derivatives of hydantoin, primary aliphatic nitroalcohols, mesyloxyethyl sulfonyl compounds, chloroethyl sulfonyl compounds, chloroethyl sulfonyl compounds, likewise in combination.

Particularly fast-acting hardeners are of particular interest in accordance with the invention. Hardeners such as these are mostly compounds which are capable of activating the carboxyl groups present in the protein-like binders, so that the carboxyl groups are capable of reacting with the amino groups present in the protein-like binder. Hardeners of this type are represented, for example, by formulae III to VIII.

In hardeners corresponding to the formulae III

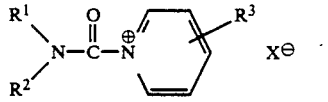

III $R^1$ and $R^2$ (which may be the same or different) represent alkyl containing from 1 to 8 C-atoms (for example methyl, ethyl), aryl containing up to 15 carbon atoms (for example phenyl, naphthyl) or aralkyl containing up to 9 carbon atoms (for example benzyl, phenethyl); alternatively, they may be combined with one another to form a cyclic amino group (for example a pyrrolidine, piperazine or morpholine ring); $R^3$ represents hydrogen, halogen, carbamoyl, sulfo, ureido, alkoxy or alkyl. The alkyl or alkoxy groups represented by $R^3$ may be further substituted, for example by a halogen atom, a carbamoyl group, a sulfo group or a ureido group. $X^{\ominus}$ is an anion, although it may be absent where $R^3$ contains a sulfo group in anionic form, so that an intramolecular salt is formed. Suitable examples of an anion are halide ions, $C10_4^{\ominus}$, $BF_4^{\ominus}$, $PF_6^{\ominus}$.

In hardeners corresponding to formula IV

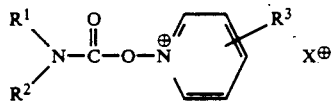

$R^1$, $R^2$, $X^{\ominus}$ are as defined for formula III.

In hardeners corresponding to formula V

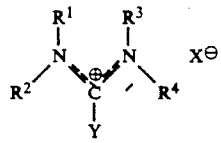

V $R^1$, $R^2$, $R^3$ and $R^4$ (which may be the same or different) represent an alkyl group containing from 1 to 20 carbon atoms (for example methyl, ethyl, butyl, 2-ethylhexyl, dodecyl, aralkyl containing up to 9 carbon atoms (for example phenyl, phenethyl, 3-pyridylmethyl) or up to 15 carbon atoms (for example phenyl, naphthyl, pyridyl). These groups may be further substituted, for example by halogen, sulfo, carbamoyl. In addition, two of the groups $R^1$, $R^2$, $R^3$ and $R^4$ may be combined with one another to form a ring, for example a pyrrolidine, piperazine, perhydroazepine, morpholine, imidazoline, tetrahydropyrimidine or tetrahydrodiazepine ring. In formula V, Y represents a group which may be split off from the compound of formula V by reaction with a nucleophilic reagent, for example a halogen atom, a sulfonyloxy group or a 1-pyridiniumyl group, $X^{\ominus}$ is as defined for formula III.

In hardeners corresponding to formula VI $$R^1-N=C=N-R^2 \qquad \text{VI}$$

$R^1$ represents alkyl containing from 1 to 10 carbon atoms (for example methyl, ethyl, 2-ethylhexyl), cycloalkyl containing from 5 to 8 carbon atoms (for example cyclohexyl), alkoxylkyl containing from 3 to 10 carbon atoms (for example methoxyethyl) or aralkyl containing up to 3 carbon atoms (for example benzyl, phenethyl). In formula VI above, $R^2$ represents a group such as $R^1$ and, preferably, a group corresponding to the following formula

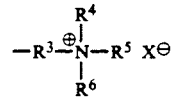

in which $R^3$ represents alkylene containing from 2 to 4 carbon atoms, $R^4$ and $R^5$ (which may be the same or different) represent alkyl containing from 1 to 6 carbon atoms or may be combined with one another and, together with the nitrogen atom, represent a heterocyclic ring (for example pyrrolidine, piperazine, morpholine) and $R^6$ represents alkyl containing from 1 to 6 carbon atoms (for example methyl, ethyl, butyl). $X^{63}$ has the same meaning as in formula III.

In the hardeners corresponding to formular VII

VII

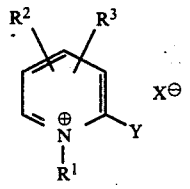

$R^1$ represents alkyl containing from 1 to 10 carbon atoms (for example methyl, ethyl, butyl), aryl containing up to 15 carbon atoms (for example phenyl, naphthyl) or aralkyl containing up to 9 carbon atoms (for example benzyl, phenethyl). These groups may be urther substituted, for example by carbomoyl, sulfamoyl or sulfo; $R^2$ and $R^3$ (which may be the same or different) represent hydrogen, halogen, acylamido, nitro, carbamoyl, ureido, alkoxy, alkyl, alkenyl, aryl, aralkyl. In formula VII, Y represents a group which is split off from the compound represented by the formula by reaction with a nucleophilic reagent, for example a halogen atom, a sulfonyloxy group or a group

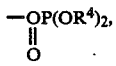

in which $R^4$ is alkyl or aryl. Where Y is a sulfonyloxy group, it may be attached to $R^1$.

$X^{\ominus}$ has the same meaning as in formula III. .

In the hardeners corresponding to formula VIII

VIII

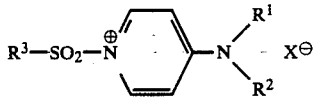

$R^1$ and $R^2$ have the same meanings as defined for R in formula III and $R^3$ represents alkyl containing from 1 to 10 carbon atoms (for example methyl, ethyl, butyl), aryl containing up to 15 carbon atoms (for example phenyl, naphthyl) or aralkyl containing up to 9 carbon atoms (for example benzyl, phenethyl). $X^{\ominus}$ has the same meaning as in formula III.

Very valuable hardeners which may be used in accordance with the invention are described in particular in DE-A-22 25 230, DE-A-23 17 677 and EP-A-0 207 399. The following are examples of suitable hardeners:

H-1

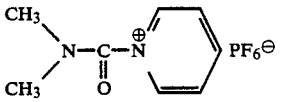

H-2

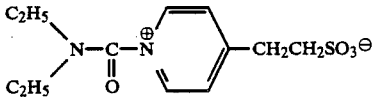

H-3

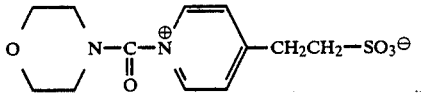

-continued

H-4

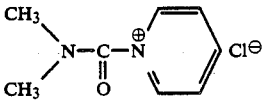

H-5

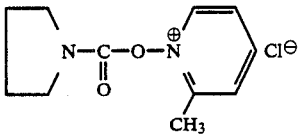

H-6

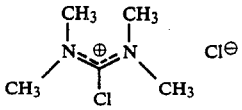

H-7

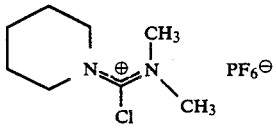

H-8

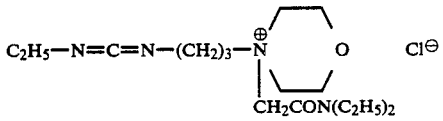

H-9

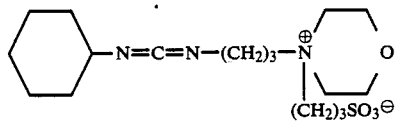

H-10

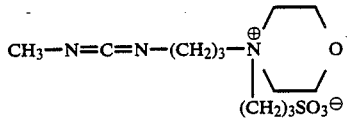

H-11

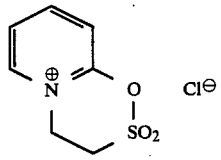

H-12

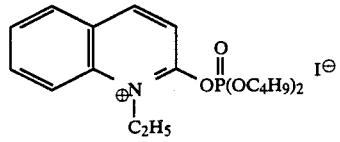

H-13

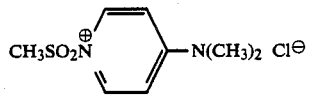

H-14

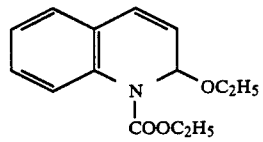

-continued

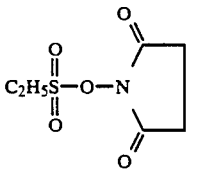

H-15

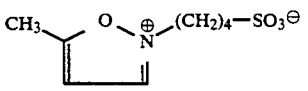

H-16

$CH_2{=}CH{-}SO_2{-}CH_2{-}SO_2{-}CH{=}CH_2$ H-17

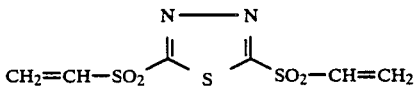

H-18

The protein-like binder preferably used is gelatin, optionally in admixture with other polymeric additives of natural or synthetic origin. Additives such as these may be, for example, albumin, casein, cellulose derivatives, sugar derivatives, sodium alginate, starch derivatives, polyvinyl alcohol, poly-N-vinyl pyrrolidone, polyacrylic acid, polyacrylamides and others. The main criterion determining the choice and composition of the binder or binder mixture is that, in the unhardened state, a sufficient number of primary or, at all events, reactive amino groups is present to guarantee adequate hardening.

A suitable measure for characterizing the degree of hardening is the swelling factor SF, i.e. the ratio between the layer thicknesses in the swollen and unswollen state. A desirable swelling factor is one in the range of from 1.5 to 3.5 and preferably in the range of from 1.8 to 2.9. The swelling factor should not undergo any significant change during storage, particularly under the effect of formaldehyde.

Since the swelling factor is principally determined by the type and quantity of hardener used in accordance with the invention, apart from an unwanted effect by formaldehyde, the hardener has to be used under such conditions, taking into account the other additives and particularly the amino group blocker according to the invention, that the desired hardening effect is in fact achieved. In general, however, and particularly when the amino group blocker to be used and the hardener to be used are substantially equally reactive, these two additives may be added either at the same time or even one after the other. The quantities in which these two compounds are used have to be selected so that the hardeners added always achieve the desired final degree of hardening; this final degree of hardening should be largely unaffected by the additional effect of the amino group blocker. The easiest way of achieving this result is to add the hardener beforehand in the quantity required for hardening and to add the amino group blocker only after the required degree of hardening has largely been reached. In this connection, the quantity in which the amino group blocker is used is not critical, providing it is used in at least that quantity which is necessary largely to block the amino groups of the protein-like binder which are not used during the hardening reaction and thus to prevent them from entering into an undesirable further reaction with formaldehyde. The reaction with the amino group blocker should not of course bring about any further hardening. Since the amino group blockers according to the invention, where they contain only one reactive group, cannot in fact bring about any hardening, it is clear that the objects of the invention are achieved with this particular embodiment. Accordingly, the hardened binder matrix produced by hardening with the hardener establishes conditions under which, according to the invention, even amino group blockers which contain two or more potentially amino-reactive groups and which are therefore potential hardeners cannot significantly con- tribute towards hardening because at best one of the reactive groups reacts with a free amino group while other reactive groups present find no other free amino groups in suitable spatial proximity in the hardened binder matrix. Accordingly, amino group blockers such as these containing further reactive groups may de facto also be termed "monofunctional", at least in this embodiment.

If the amino group blocker is used first and the hardener afterwards, the dosing of the amino group blocker must be fairly accurate because, at all events, just so many amino groups are intended to remain over in this reaction that the desired degree of hardening can still be achieved in the subsequent hardening reaction. If, therefore, the amino group blocker is used in too large a quantity, adequate hardening can no longer be subsequently obtained. If, on the other hand, the amino group blocker is used in too small a quantity, enough amino groups remain available for the unwanted reaction with formaldehyde, even after hardening, so that in this case the objects of the invention are not fully achieved. Suitable quantities of hardener and amino group blocker may readily be determined by the person skilled in the art by routine series tests. The same also applies in cases where the hardener and amino group blocker are used simultaneously, in which case it is particularly important to watch for and to take into account a possible difference in reactivity between the two additives.

In other respects, the compounds used in accordance with the invention are added in the same way in which hardeners are normally added. The hardener and amino group blocker may be added to the casting solution at the same time and also successively. They may be added to one, several or even all of the layers of the photographic recording material. They may be added to one or more layers with which the photographic recording material is coated. They may also be separately added, for example by adding the hardener to one, more or all of the essential layers of the photographic recording material and applying the amino group blocker by coating the photographic recording material thus prepared with a layer containing the amino group blocker in a sufficient quantity or, in accordance with Example 1, by treating it with a solution containing the amino group blocker. The reverse procedure is also possible.

The photosensitive silver halide emulsions used in the photosensitive layers may contain chloride, bromide and iodide or mixtures thereof as halide. For example, the halide of at least one layer may consist of 0 to 12 mole % iodide, 0 to 50 mole % chloride and 50 to 100 mole % bromide. In certain embodiments, the crystals are predominantly compact crystals which are, for example, cubic or octahedral or have transitional forms. They may be characterized by the fact that they mostly have a thickness of greater than 0.2 μ. The average ratio of diameter to thickness is preferably less than 8:1, the diameter of a crystal being defined as the diameter of a circle with an area corresponding to the projected area of the crystal. In another preferred embodiment, however, all the emulsions or individual emulsions may even contain substantially tablet-form silver halide crystals in which the ratio of diameter to thickness is greater than 8:1. The emulsions may be heterodisperse or even monodisperse emulsions which preferably have a mean grain size of from 0.3 μ to 1.2 μ. The silver halide grains may even have a layered grain structure.

The emulsions may contain the usual casting aids and plasticizers, cf. Research Disclosure 17643, December 1978, more especially Chapters XI and XII.

The emulsions may be chemically and/or spectrally sensitized in the usual way.

Suitable chemical sensitizers, spectral sensitizing dyes and stabilizers are described, for example, in Research Disclosure 17643; cf. in particular Chapters III, IV and VI.

Although the invention may be applied to any type of photographic recording materials containing protein-like binders as layer binder, it may be applied with particular advantage to color photographic recording materials, especially those which contain color couplers and which are processed by the chromogenic development process.

Other photographic recording materials normally contain at least one silver halide emulsion layer for recording light of each of the three spectral regions red, green and blue. To this end, the photosensitive layers are spectrally sensitized in known manner by suitable sensitizing dyes. Blue-sensitive silver halide emulsion layers do not necessarily have to contain a spectral sensitizer because the natural sensitivity of the silver halide is often sufficient for recording blue light.

Each of the photosensitive layers mentioned may consist of a single layer or, in known manner, for example as in the so-called double layer arrangement, may also comprise two or even more partial silver halide emulsion layers (DE-C-1 121 470). Normally, red-sensitive silver halide emulsion layers are arranged nearer the layer support than green-sensitive silver halide emulsion layers which in turn are arranged nearer than blue-sensitive emulsion layers, a non-photosensitive yellow filter layer generally being arranged between the green-sensitive layers and blue-sensitive layers. However, other arrangements are also possible. A non-photosensitive intermediate layer, which may contain agents to prevent the unwanted diffusion of developer oxidation products, is generally arranged between layers of different spectral sensitivity. Where several silver halide emulsion layers of the same spectral sensitivity are present, they may be arranged immediately adjacent one another or in such a way that a photosensitive layer of different spectral sensitivity is present between them (DE-A-1 958 709, DE-A-2 530 645, DE-A-2 622 922).

Color photographic recording materials for the production of multicolored images normally contain dye producing compounds, in the present case particularly color couplers, for producing the different component dye images cyan, magenta and yellow, in spatial and spectral association with the silver halide emulsion layers of different spectral sensitivity.

In the context of the invention, spatial association means that the color coupler is present in such a spatial relationship to the silver halide emulsion layer that the two are capable of interacting in such a way as to allow imagewise accordance between the silver image formed during development and the dye image produced from the color coupler. This result is generally achieved by the fact that the color coupler is contained in the silver halide emulsion layer itself or in an adjacent, optionally non-photosensitive binder layer.

By spectral association is meant that the spectral sensitivity of each of the photosensitive silver halide emulsion layers and the color of the component dye image produced from the particular spatially associated color coupler bear a certain relationship to one another, a component dye image relating to another color (generally for example the colors cyan, magenta or yellow in that order) being associated with each of the spectral sensitivities (red, green, blue).

One or more color couplers may be associated with each of the differently spectrally sensitized silver halide emulsion layers. Where several silver halide emulsion layers of the same spectral sensitivity are present, each of them may maintain a color coupler, the color couplers in question not necessarily having to be the same. They are merely required to produce at least substantially the same color during color development, normally a color which is complementary to the color of the light to which the silver halide emulsion layers in question are predominantly sensitive.

In preferred embodiments, therefore, at least one non-diffusing color coupler for producing the cyan component dye image, generally a coupler of the phenol or α-naphthol type, is associated with red-sensitive silver halide emulsion layers. At least one non-diffusing color coupler for producing the magenta component dye image, normally a coupler of the 5-pyrazolone, indazolone or pyrazoloazole type, is associated with green-sensitive silver halide emulsion layers. Finally, at least one non-diffusing color coupler for producing the yellow component dye image, generally a color coupler containing an open-chain ketomethylene group, is associated with blue-sensitive silver halide emulsion layers. Color couplers of this type are known in large numbers and are described in a number of patent specifications. Reference is made here for example to the publications "Farbkuppler (Color Couplers)" by W. PELZ in "Mitteilungen aus den Forschungslaboratorien der Agfa, Leverkusen/München", Vol. III, page 111 (1961) and by K. VENKATARAMAN in "The Chemistry of Synthetic Dyes", Vol. 4, 341 to 387, Academic Press (1971).

The color couplers may be both typical 4-equivalent couplers and also 2-equivalent couplers in which a smaller quantity of silver halide is required for dye production. 2-equivalent couplers are known to be derived from the 4-equivalent couplers in that they contain in the coupling position a substituent which is eliminated during the coupling reaction. 2-equivalent couplers include both those which are substantially colorless and also those which have a strong color of their own which either disappears during the color coupling reaction or is replaced by the color of the image dye produced. Couplers of the latter type may also be additionally present in the photosensitive silver halide emulsion layers where they serve as masking couplers for compensating the unwanted secondary densities of the image dyes. However, 2-equivalent couplers also include the known white couplers, although couplers such as these do not produce a dye on reaction with color developer oxidation products. 2-equivalent couplers also include couplers which contain in the coupling position a releasable group which is released on reaction with color developer oxidation products and, in the process, develops a certain, desirable photographic activity, for example as a development inhibitor or accelerator. Examples of 2-equivalent couplers such as these are the known DIR couplers and also DAR and FAR couplers. The releasable group may also be a ballast group, so that coupling products, for example dyes, which are diffusible or which at least show slight or limited mobility are obtained during the reaction with color develop oxidation products. By slight or limited mobility is meant a mobility which is gauged in such a way that the contours of the discrete dye patches formed during chromogenic development blend and merge with one another. This degree of mobility should be distinguished, on the one hand, from the usual case of complete immobility in photographic layers which, in conventional photographic recording materials, is required for the color couplers or rather for the dyes produced therefrom in order to obtain maximal definition and, on the other hand, from the case of total mobility of the dyes as required, for example, in dye diffusion processes. The last-mentioned dyes generally contain at least one group which renders them soluble in alkaline medium. The extent of the slight mobility required in accordance with the invention may be controlled by varying substituents in order, for example, specifically to influence solubility in the organic medium of the oil former or affinity for the binder matrix.

High molecular color couplers are described, for example, in DE-C-1 297 417, DE-A-24 07 569, DE-A-31 48 125, DE-A-32 17 200, DE-A- 33 20 079, DE-A-33 24 932, DE-A-33 31 743, DE-A-33 40 376, EP-A-27 284 and US-A4 080 211. The high molecular weight color couplers are generally prepared by polymerization of ethylenically unsaturated monomeric color couplers.

The use of the amino group blockers in accordance with the invention enables photographic recording materials to be protected against the damaging effect of formaldehyde. This damaging effect of formaldehyde is particularly troublesome in color photographic recording materials because any excessive hardening of the layers under the effect of formaldehyde impairs the through-developability of the layers, so that inadequate maximal color densities are obtained. This effect is particularly pronounced in the case of the magenta coupler (normally a pyrazolone) where it may be assumed that the damaging effect of the formaldehyde is attributable hot only to excessive hardening of the layers, but also to inactivation of the couplers. According to the invention, therefore, the damaging effect of formaldehyde can be at least partly eliminated even in the case of magenta couplers of this type. Surprisingly, however, the protective effect of the amino group blockers used in accordance with the invention is particularly noticeable in the case of magenta couplers of the type which are already regarded as such as being relatively immune to formaldehyde, namely magenta couplers of the pyrazoloazole type. Accordingly, the invention may be applied with particular advantage to color photographic recording materials containing pyrazoloazole couplers PA. Couplers such as these correspond to the following formula

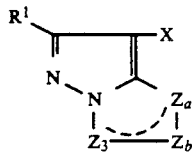

IX in which $R^1$ represents hydrogen, alkyl, aryl, alkoxy, amino, acylamino, anilino;

X represents hydrogen or a group releasable by color coupling;

$Z_a$, $Z_b$ and $Z_c$ each represent an optionally substituted methine group, =N- or NH-.

Examples of pyrazoloazole couplers such as these are 1H-imidazo[1,2-b]-pyrazoles (for example pyrazolobenzimidazoles), 1H-pyrazolo[1,5-b]-pyrazoles, 1H-pyrazolo[5,1-c]-1,2,4-triazoles, 1H-pyrazolo[1,5-b]-1,2,4-triazoles and 1H-pyrazolo[1,5-d]-tetrazoles.

Particularly suitable, special pyrazoloazoles PA are listed below:

| | | |
|---|---|---|
| PA-1 | 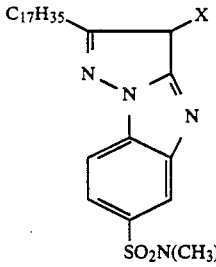 | X = H |
| PA-2 | | X = —S—$C_6H_{13}$ |
| PA 3 | | X = 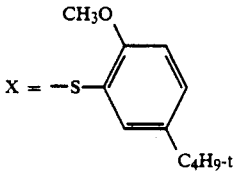 |
| PA 4 | " | X = Cl |
| PA 5 | " | X = Br |

-continued
PA 6 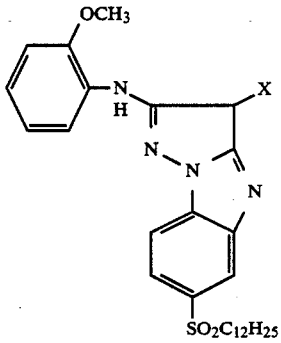
X = H
PA 7
X = 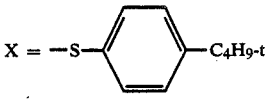
PA 8 "
X = 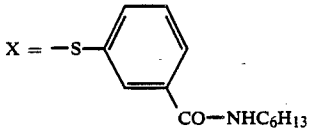
PA 9 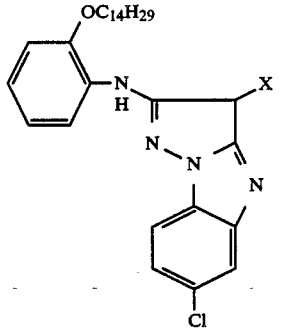
X = 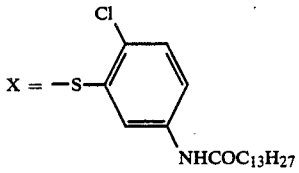
PA 10
X = 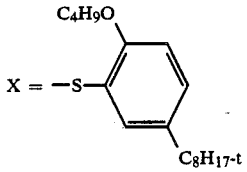
PA 11 "
X = $-S-C_4H_9$
PA-12 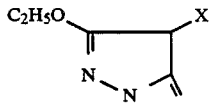
X = H
PA-13
X = 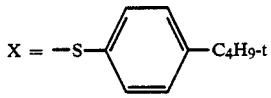
PA-14 "
X = 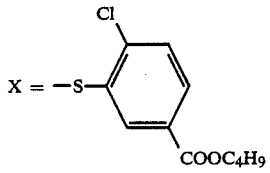
PA-15 "
X = Cl -continued
PA-16 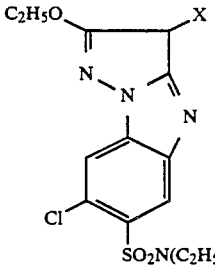
X = 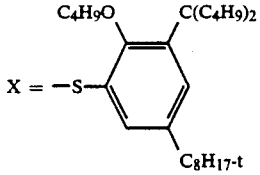
PA-17
X = 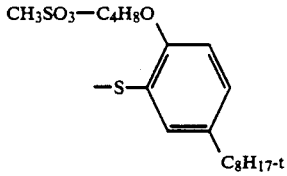
PA-18 ″
X = 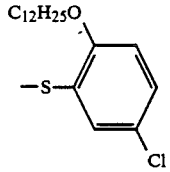
PA-19 ″
X = 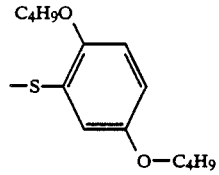
PA-20 ″ X = $-S-C_{12}H_{25}$
PA-21 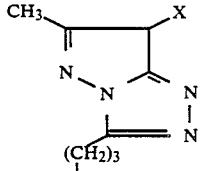
X = Cl
PA-22 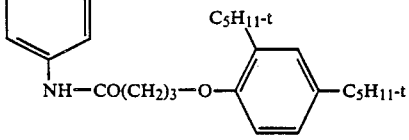
X = 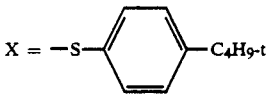
PA-23 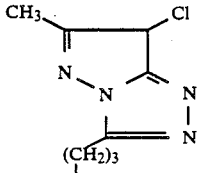
R = 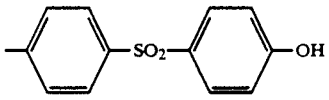
PA-24 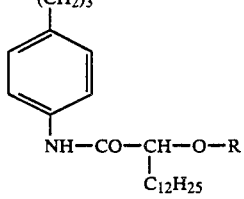
R = 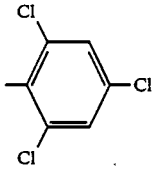
PA-25 ″
R = 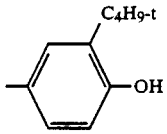

-continued

PA-26 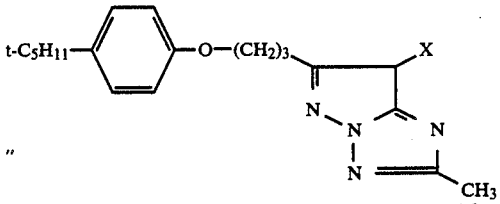 X = H

PA-27 " X = Cl

[acc. to EP O 119 860]

PA-28 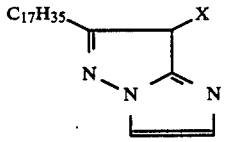 X = H

PA-29 " [acc. to EP 0 119 741] X = Cl

PA-30 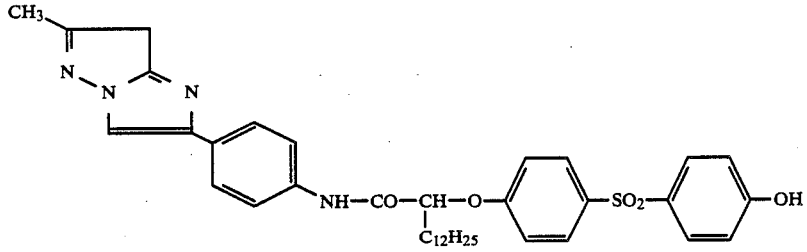

PA-31 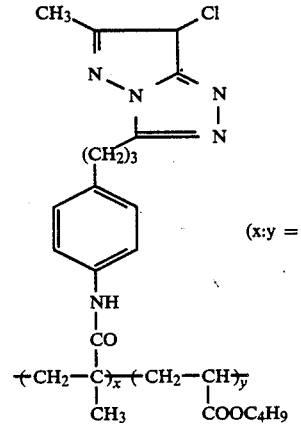

(x:y = 35:65 % by weight)

In addition to the constituents mentioned, the photographic recording material according to the invention may contain other standard additives, such as for example antioxidants, dye stabilizers and agents for influencing mechanical and electrostatic properties. In order to prevent or avoid the adverse effect of UV light on the colored images produced with color photographic recording materials according to the invention, it is of advantage for example to use UV-absorbing compounds in one or more of the layers contained in the recording material, preferably in one of the upper layers. Suitable UV-absorbers are described, for example, in US-A-3 253 921, DE-C-2 036 719 and EP-A-0 057 160.

To produce color photographic images, the recording material according to the invention, which contains at least one silver halide emulsion layer and at least one color coupler of formula I associated therewith, is developed with a color developer compound. The color developer compound used may be any color developer compound which is capable of reacting with color couplers in the form of its oxidation product to form azomethine or indoquinone dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methylsulfonamidoethyl)3-methyl-p-phenylenediamine, 1-(N-ethyl-N-hydroxymethyl)3-methyl-p-phenylenediamine and 1-(N-ethyl-N-methoxyethyl)3-methyl-p-phenylenediamine.

EXAMPLE 1

A photographic recording material A was prepared by successively applying the following layers to a transparent layer support of polyethylene terephthalate provided with an anti-halo layer. All the quantities indicated are based on 1 $m^2$. For the silver applied, the corresponding quantities of $AgNO_3$ are indicated.

1. A low-sensitivity red-sensitized layer containing a silver bromide iodide emulsion (6 mole % iodide) of 3.4 g $AgN)_3$ containing 1.0 g of the cyan coupler C-1, 40 mg of the DIR coupler DIR-1, 60 mg of the masking coupler Z-1 and 3.0 g gelatin.

2. A high-sensitivity, red-sensitized layer containing a silver bromide iodide emulsion (10 mole % iodide) of 2.0 g $AgNO_3$ containing 0.13 g of the cyan coupler C-1 and 1.5 g gelatin.
3. An intermediate layer of 0.6 g gelatin.
4. A low-sensitivity green-sensitized layer containing a silver bromide iodide emulsion (5 mole % iodide) of 2.0 g $AgNO_3$ containing 0.6 g of the magenta coupler M-1, 50 mg of the DIR coupler DIR-2, 50 mg of the masking coupler Z-2 and 3.0 g gelatin.
5. A high-sensitivity green-sensitized layer containing a silver bromide iodide emulsion (9 mole % iodide) of 2.2 g $AgNO_3$ containing 0.2 g of the magenta coupler M-1 and 1.5 g gelatin.
6. An intermediate layer containing 0.5 g gelatin.
7. A yellow filter layer of colloidal silver having a density of 0.6.
8. A low-sensitivity blue-sensitized layer containing a silver bromide iodide emulsion (6 mole % iodide) of 1.0 g $AgNO_3$ containing 1.05 g of the yellow coupler Y-1 and 1.3 g gelatin.
9. A high-sensitivity blue-sensitized layer containing a silver bromide iodide emulsion (8.5 mole % iodide) of 0.8 g $AgNO_3$ containing 0.26 g of the yellow coupler Y-1 and 0.7 g gelatin.
10. A cover layer of 1.2 g gelatin.
11. A hardening layer of 0.25 g gelatin and 0.8 g of the hardener H-3.

other recording materials B, C and D were prepared in the following way, but with the following differences:

Recording material B: as A, but with magenta coupler M-2 instead of M-1 in layers 4 and 5.

Recording material C: as A, but with the hardener H-17 instead of H-3 in layer 11.

Recording material D: as B, but with the hardener H-17 instead of H-3 in layer 11.

The quantities in which the hardeners H-3 and H-17 were used were selected so that substantially the same swelling factors SF were obtained.

Compounds used:

C-1

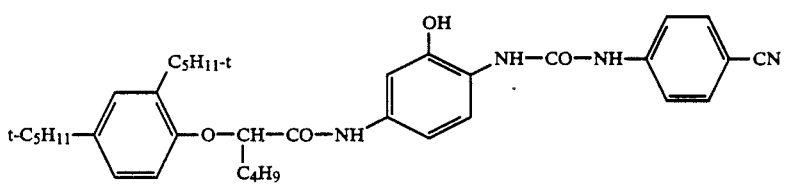

DIR-1

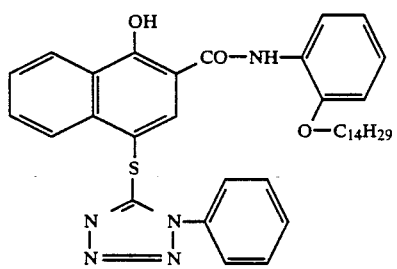

Z-1

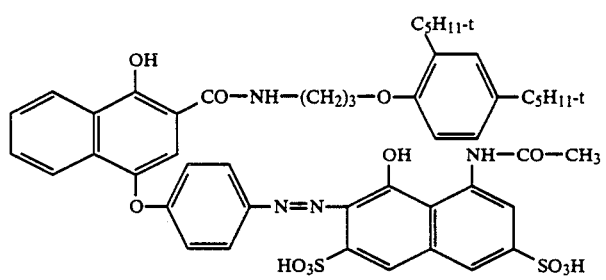

M-1

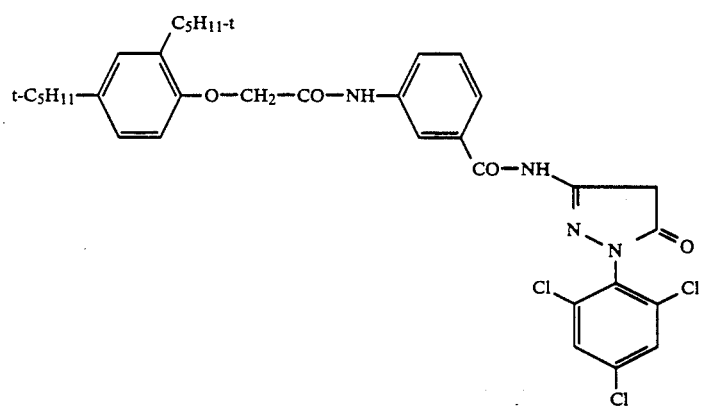

-continued
DIR-2
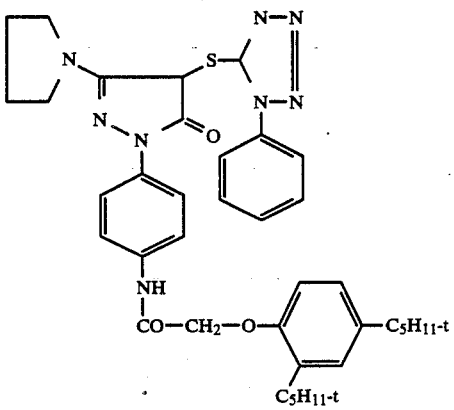
Z-2
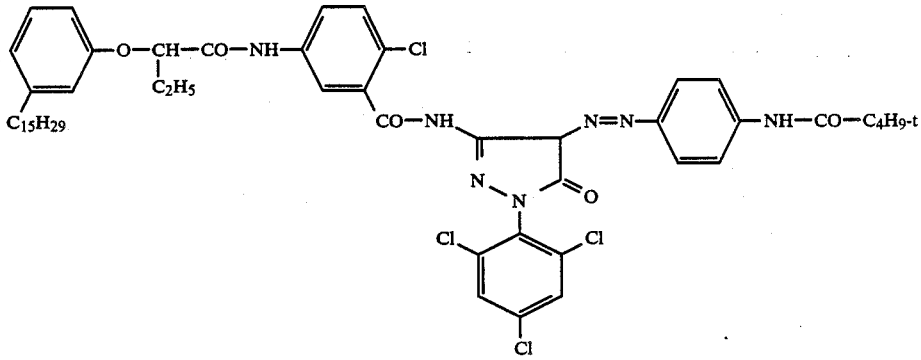
Y-1
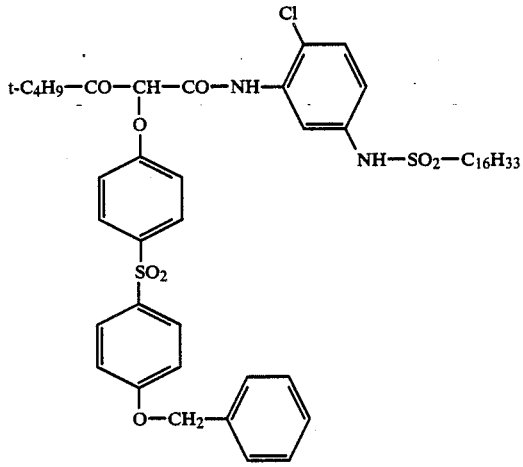
M-2
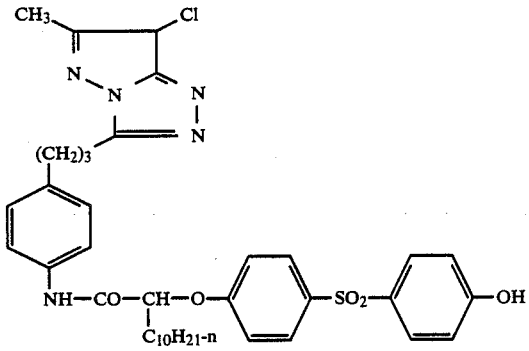
The recordingmaterials A, B, C and D thus prepared, after different pretreatments, were further treated as follows in five different test series. The were stored for 1 week at room temperature and then for 1 week in an atmosphere containing 4 ppm formaldehyde for 70% relative humidity, exposed behind a grey wedge and processed by the negative development process described in "The British Journal of Photography", 1974, pages 597 to 598.

The pretreatments applied were as follows:

| | |
|---|---|
| 1st. | test series ($A_1$, $B_1$, $C_1$, $D_1$)- no treatment |
| 2nd. | test series ($A_2$, $B_2$, $C_2$, $D_2$) The recording materials were rinsed for 3 minutes and then dried. |
| 3rd.-5th. | test series The recording materials were treated for 3 minutes with a 5% aqueous or aqueous-alcoholic solution of the compounds AB-18 ($A_3$, $B_3$, $C_3$, $D_3$) AB-19 ($A_4$, $B_4$, $C_4$, $D_4$) AB-20 ($A_5$, $B_5$, $C_5$, $D_5$) and then dried. |

The results (maximal color density $D_{max}$ and swelling factor SF) are shown in Table 1 below. For the recording materials which were only pretreated and not exposed to the formaldehyde, the results are shown in brackets.

TABLE 1

| Sample | SF | $D_{max}$ |
|---|---|---|
| $A_1$ | 2.15 (2.4) | 1.71 (2.95) |
| $A_2$ | 2.10 (2.4) | 1.50 (2.95) |
| $A_3$ | 2.20 (2.2) | 1.84 (2.85) |
| $A_4$ | 2.40 (2.4) | 1.86 (2.90) |
| $A_5$ | 2.40 (2.4) | 1.98 (2.95) |
| $B_1$ | 2.20 (2.4) | 2.56 (3.35) |
| $B_2$ | 2.15 (2.4) | 2.40 (3.40) |
| $B_3$ | 2.20 (2.2) | 2.99 (3.25) |
| $B_4$ | 2.35 (2.4) | 3.05 (3.30) |
| $B_5$ | 2.45 (2.45) | 3.25 (3.30) |
| $C_1$ | 2.15 (2.4) | 1.80 (2.90) |
| $C_2$ | 2.10 (2.4) | 1.71 (2.95) |
| $C_3$ | 2.30 (2.3) | 2.01 (2.80) |
| $C_4$ | 2.40 (2.4) | 1.98 (2.85) |
| $C_5$ | 2.35 (2.4) | 1.95 (2.85) |
| $D_1$ | 2.08 (2.4) | 2.61 (3.35) |
| $D_2$ | 2.19 (2.5) | 2.62 (3.40) |
| $D_3$ | 2.20 (2.25) | 2.98 (3.25) |
| $D_4$ | 2.35 (2.4) | 3.15 (3.30) |
| $D_5$ | 2.35 (2.4) | 3.25 (3.30) |

It can be seen from Table 1 that not only is the loss of color density caused by formaldehyde greatly reduced by the treatment with the amino group blockers according to the invention, but also that this reduction is particularly noticeable where the magenta color M-2 is used.

EXAMPLE 2

A photographic recording material E comprising the following layers was prepared in the same way as in Example 1:

1. An antihalo layer containing 0.18 g colloidal silver, 0.3 g UV absorber UV-2 and 1.5 g gelatin.
2. A silver- and coupler-containing intermediate layer containing a silver bromide iodide emulsion (0.8 mole % iodide) of 0.1 g $AgNO_3$ containing 0.11 g masking coupler Z-3, 0.15 g 2,5-dioctylhydroquinone and 0.3 g gelatin.
3. A first red-sensitive layer containing a silver bromide iodide emulsion (5 mole % iodide) of 1,8 g AgN03 containing 0.30 g cyan coupler C-1, 0.10 g cyan coupler C-2, 0.01 g DIR coupler DIR-1 and 1.2 g gelatin.
4. A second red-sensitive layer containing a silver bromide iodide emulsion (10 mole % iodide) of 2.4 g $AgNO_3$ containing 0.05 g cyan coupler C-1, 0.10 g cyan coupler C-2, 0.05 g cyan coupler C-3 and 1.6 g gelatin.
5. A third red-sensitive layer containing a silver bromide iodide emulsion (10 mole % iodide) of 1.0 g $AgNO_3$ containing 0.05 g cyan coupler C-1, 0.15 g cyan coupler C-3, 3 mg DIR coupler DIR-3 and 0.8g gelatin.
6. An intermediate layer containing 0.5 g gelatin.
7. A first green-sensitive layer containing a silver bromide iodide emulsion (5 mole % iodide) of 1.5 g $AgNO_3$ containing 0.30 g magenta coupler M-1, 0.04 g masking coupler Z-4, 0.05 g masking coupler Z-5, 0.005 g DIR coupler DIR-4 and 1.2 g gelatin.
8. A second green-sensitive layer containing a silver bromide iodide emulsion (6 mole % iodide) of 2.0 g L 5 $AgNO_3$ containing 0.25 g magenta coupler M-1, 0.01 g masking coupler Z-4, 0.01 g masking coupler Z-5, 0.01 g DIR coupler DIR-4 and 1.7 g gelatin.
0 9 A third green-sensitive layer containing a silver bromide iodide emulsion (10 mole % iodide) of 1.45 g $AgNO_3$ containing 0.070 g magenta coupler M-2, 0.015 g masking coupler Z-4, 0.002 g coupler Z-6 and 1.0 g gelatin.
10. A yellow filter layer containing 0.05 g yellow colloidal silver, 0.03 g 2.5-di-tert.-octylhydroquinone and 0.6 g gelatin.
11. A first blue-sensitive layer containing a silver bromide iodide emulsion (5 mole % iodide) of 0.7 g $AgNO_3$ containing 0.70 g yellow coupler Y-1, 0.03 g DIR coupler DIR-5 and 1.4 g gelatin.
12. A second blue-sensitive layer containing a silver bromide iodide emulsion (5 mole % iodide) of 0.5 g $AgNO_3$ containing 0.25 g yellow coupler Y-1 and 0.6 g gelatin.
13. A micrate intermediate layer containing a fine-grained silver bromide iodide emulsion (2 mole % iodide) of 0.5 g AgN03 and 0.1 g gelatin.
14. A third blue-sensitive layer containing a silver halide emulsion (10 mole % iodide) of 0.5 g $AgNO_3$ containing 0.20 g yellow coupler Y-1 and 0.50 g gelatin.
15. A protective layer containing 0.14 g UV absorber UV-1, 0.20 g UV absorber UV-2 and 0.4 g gelatin.
16. A hardening layer containing 0.95 g hardener H-3 and 0.23 g gelatin.

The following compounds were used (see also Example 1):

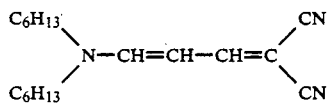

UV-1

-continued
UV-2
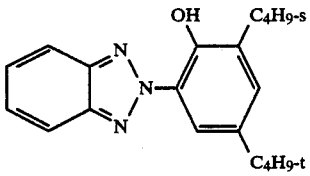
Z-3
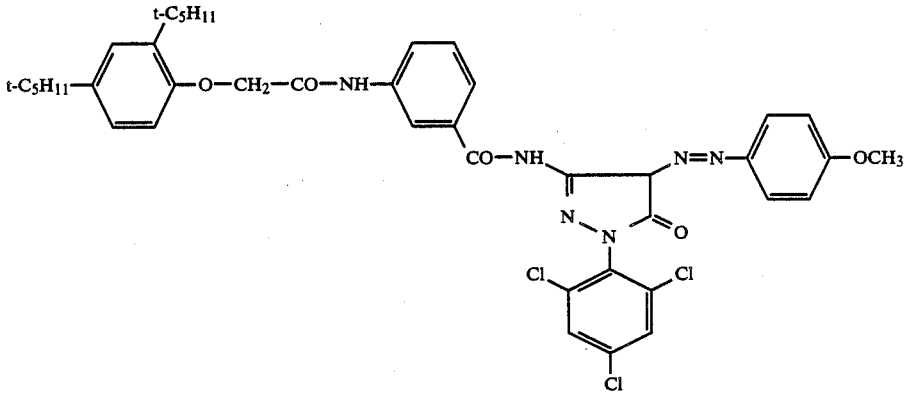
C-2
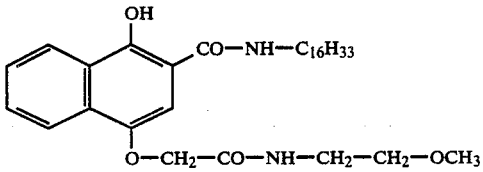
C-3
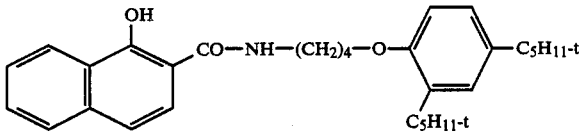
DIR-3
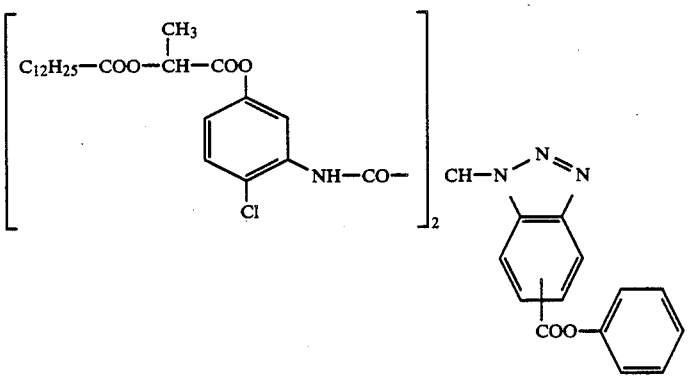

-continued
Z-4
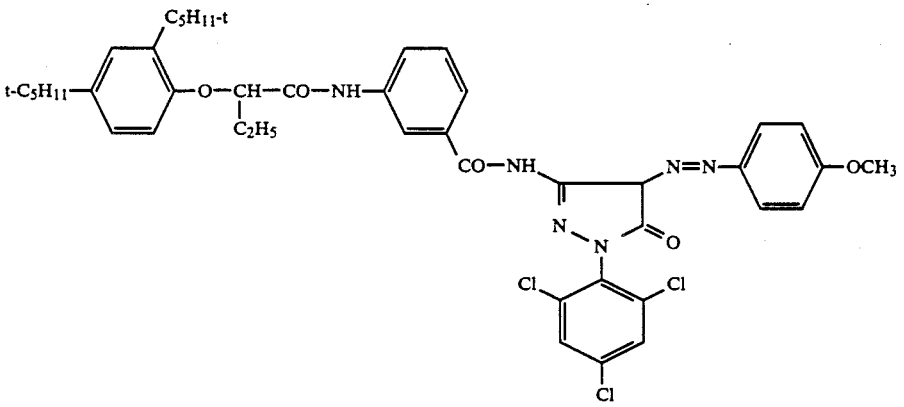
Z-5
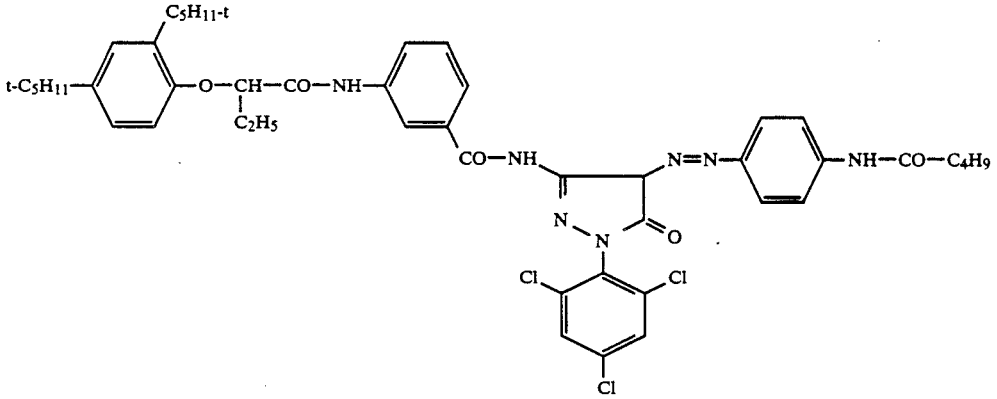
DIR-4
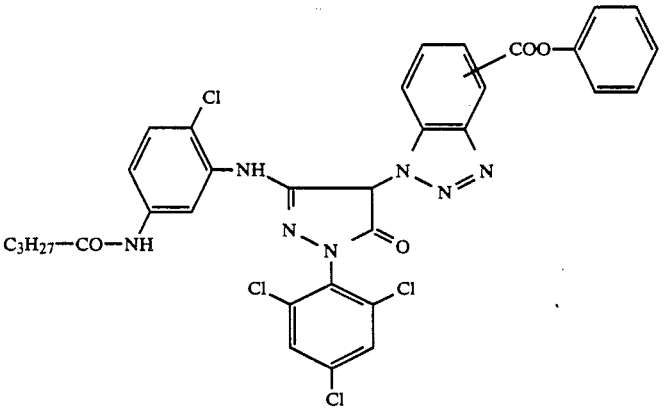
Z-6
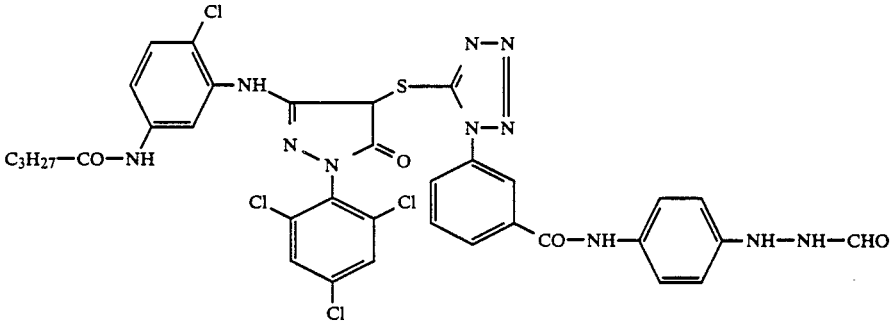

-continued

DIR-5

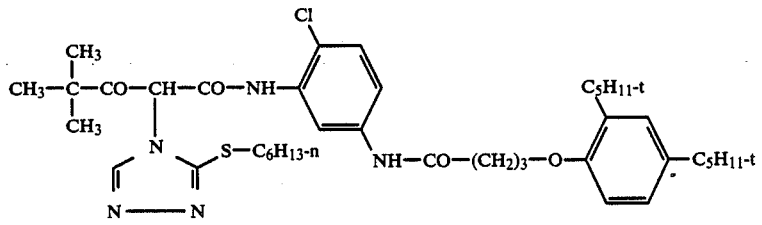

Further recording materials F to J were prepared, differing from recording material E solely in the fact that layer 16 additionally contained 0.5 g of one of the following amino group blockers:

| Recording material | Amino group blocker |
|---|---|
| F | AB-2 |
| G | AB-4 |
| H | AB-21 |
| I | AB-22 |
| J | AB-23 |

The recording materials E to J were stored for 1 week at room temperature. The swelling factor SF was then determined. A sample of each material was stored in a formaldehyde-free atmosphere. Further samples were stored for 3,7,14 and 21 days in an atmosphere containing 4 ppm formaldehyde for 70% relative air humidity. All the samples were then selectively exposed to green light and processed in the same way as in Example 1.

TABLE 2

| Material | SF | $D_{max}$ | Reduction $D_{max}$ in % after exposure to $CH_2O$ for 3 | 7 | 14 | 21 days |
|---|---|---|---|---|---|---|
| E | 2.4 | 2.28 | 0 | 2 | 15 | 32 |
| F | 2.1 | 2.10 | 0 | 1 | 2 | 5 |
| G | 2.3 | 2.30 | 0 | 1 | 4 | 16 |
| H | 2.4 | 2.28 | 0 | 1 | 5 | 12 |
| I | 2.3 | 2.14 | 0 | 1 | 2 | 8 |
| J | 1.9 | 1.98 | 0 | 1 | 8 | 10 |

In the case of material E, the swelling factor had fallen to 1.8 after 21 days. In the case of the other materials, the swelling factor remained unchanged. This shows that the amino group blockers according to the invention, without themselves significantly contributing towards hardening, modify the binder to such an reduction in maximal color density are effectively prevented.

We claim:

1. A photographic recording material comprising at least one photosensitive silver halide emulsion layer and at least one layer containing a hardened protein-like binder which contains free primary amino groups in its non-hardened state, characterized in that the hardened protein-like binder contains amino groups corresponding to the formula —NH—R, in which R is the residue of a low molecular weight monofunctional compound which has been reacted with the free primary amino groups of the hardened protein-like binder under storage conditions without significantly contributing towards hardening, wherein said low molecular weight monofunctional compound corresponds to one of the following formulae I and II:

X—R I

Y—R′ II in which

X represents an activated atom or an activated group which is attached to a C-atom of the substituent R and may be displaced therefrom by an N-atom of a primary amino group;

R is an organic radical containing at least one group by which the atom or the group X is activated;

Y represents an activated group not which a primary amino group may be added in a 1,2- or 1,4-addition reaction;

R′ is an organic radical by which the group Y may optionally be activated.

2. A recording material as claimed in claim 1, characterized by the presence of at least one silver halide emulsion layer for recording light of at least one silver halide emulsion layer for recording light of each of the three spectral regions red, green and blue containing respectively spectrally associated color couplers.

3. A recording material as claimed in claim 2, characterized by the presence of a pyraxoloazole coupler corresponding to the following formula

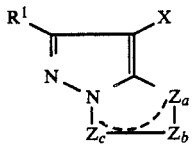

in which $R^1$ represents hydrogen, alkyl, aryl, alkoxy, amino, acylamino, anilino;

X represents hydrogen or a group releasable by color coupling: $Z_a$, $Z_b$ and $Z_c$ each represent an optionally substituted methine group, =N— or —NH—.

4. A recording material as claimed in any of claims 1, 2, or 3 characterized in that the protein-like binder has been hardened with a hardener which activates carboxyl groups.

5. A recording material as claimed in claim 4, characterized in that the binder has been hardened with a hardener corresponding to the following formula

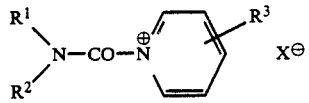

in which $R^1$ and $R^2$ (same or different) represent alkyl containing from 1 to 8 C-atoms or aralkyl containing up to 9

C-atoms or $R^1$ and $R^2$ together with the N-atom represent a cyclic amino group;

$R^3$ represents hydrogen, halogen, carbamoyl, sulfo, ureido, alkoxy or alkyl;

$X^{63}$ represents an anion which may be absent where $R^3$ contains a sulfo group in anionic form.

6. A process for the production of a photographic recording material comprising at least one photosensitive silver halide emulsion layer and at least one layer containing a hardened protein-like binder which contains free primary amino groups in its non-hardened state, characterized in that first a hardener and then a ,low molecular weight monofunctional compound which is capable of reacting with the free amino groups of the protein-like binder under storage conditions are allowed to act on the protein-like binder of at least one layer, wherein said low molecular weight monofunctional compound corresponds to one of the following formulae I and II:

$$X—R \qquad \text{I}$$

$$Y—R' \qquad \text{II}$$

in which

X represents an activated atom or an activated group which is attached to the C-atom of the substituent R and which may be displaced therefrom by an N-atom of a primary amino group;

R represent san organic radical containing at least one group by which the atom or the group X is activated;

Y represents an activated group onto which a primary amino group may be added in a 1,2,- or 1,4-addition reaction;

R' represents an organic radical by which the group Y may optionally be activated.

* * * * *

UNITED STATES PATENT AND TRADEMARK OFFICE

CERTIFICATE OF CORRECTION

PATENT NO. : 4,939,079

DATED : July 3, 1990

INVENTOR(S) : ERICH WOLFF, ET AL.

It is certified that error appears in the above-identified patent and that said Letters Patent is hereby corrected as shown below:

At Column 2, Line 12, "oldehydes" should read -- aldehydes--;
Line 13, "oldehyde" should read -- aldehyde--.

At Column 16, Line 25, in Formula IX, "$Z_3$" should read -- $Z_c$ -- .

At Column 20, Line 1, the substituent in the upper right-hand corner of the formula should read -- $N(C_4H_9)_2$ -- .

At Column 22, Line 68, "3.4 g $AgN)_3$" should read -- 3.4 g $AgNO_3$ -- .

At Column 25, in Formula DIR-2, the upper right-hand tetrazole ring should read

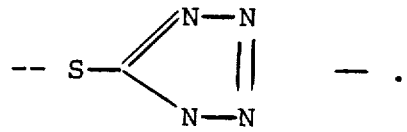

UNITED STATES PATENT AND TRADEMARK OFFICE

CERTIFICATE OF CORRECTION

PATENT NO. : 4,939,079

DATED : July 3, 1990

INVENTOR(S) : ERICH WOLFF, ET AL.

It is certified that error appears in the above-identified patent and that said Letters Patent is hereby corrected as shown below:

In Claim 1, Column 34, Line 24, "not" should read -- onto -- .

In Claim 2, Column 34, lines 31-32, please delete "of at least one silver halide emulsion layer for recording", second occurrence.

In Claim 3, Column 34, Line 36, "pyraxoloazole" should read -- pyrazoloazole -- .

In Claim 5, Column 35, Line 6, "$X^{63}$" should read -- $X^{\Theta}$ -- .

In Claim 6, Column 35, Line 15, ",low" should read -- low -- .

UNITED STATES PATENT AND TRADEMARK OFFICE

CERTIFICATE OF CORRECTION

PATENT NO. : 4,939,079

DATED : July 3, 1990

INVENTOR(S) : ERICH WOLFF, ET AL.

It is certified that error appears in the above-identified patent and that said Letters Patent is hereby corrected as shown below:

In Claim 6, Column 36, Line 13, "represent san" should read

-- represents an --.

Signed and Sealed this

Twenty-fourth Day of December, 1991

*Attest:*

HARRY F. MANBECK, JR.

*Attesting Officer*

*Commissioner of Patents and Trademarks*